US009835292B2

(12) United States Patent
Wyper et al.

(10) Patent No.: US 9,835,292 B2
(45) Date of Patent: Dec. 5, 2017

(54) NATURAL GAS TIME FILL POST SYSTEM

(71) Applicant: Fueling and Service Technologies, Inc., Buena Park, CA (US)

(72) Inventors: Thompson William Wyper, Fullerton, CA (US); Milton Daniel McGill, La Habra Heights, CA (US)

(73) Assignee: Fueling and Service Technologies, Inc., Buena Park, CA (US)

( * ) Notice: Subject to any disclaimer, the term of this patent is extended or adjusted under 35 U.S.C. 154(b) by 79 days.

(21) Appl. No.: 14/951,456

(22) Filed: Nov. 24, 2015

(65) Prior Publication Data

US 2016/0146402 A1 May 26, 2016

Related U.S. Application Data

(60) Provisional application No. 62/123,790, filed on Nov. 26, 2014.

(51) Int. Cl.
*F17C 5/06* (2006.01)
*F17C 5/00* (2006.01)

(52) U.S. Cl.
CPC ..... *F17C 5/06* (2013.01); *F17C 5/007* (2013.01); *F17C 2205/0142* (2013.01); *F17C 2205/0332* (2013.01); *F17C 2205/0364* (2013.01); *F17C 2221/033* (2013.01); *F17C 2223/0123* (2013.01); *F17C 2223/033* (2013.01); *F17C 2225/0123* (2013.01); *F17C 2225/036* (2013.01); *F17C 2227/0157* (2013.01); *F17C 2260/015* (2013.01); *F17C 2265/01* (2013.01); *F17C 2265/065* (2013.01); *F17C 2270/0139* (2013.01)

(58) Field of Classification Search
CPC .... F17C 5/06; F17C 5/007; F17C 2270/0139; F17C 2265/065; F17C 2265/01; F17C 2260/015; F17C 2227/0157; F17C 2225/036; F17C 2225/0123; F17C 2223/033; F17C 2223/0123; F17C 2221/033; F17C 2205/0364; F17C 2205/0332; F17C 2205/0142
USPC ..... 141/4
See application file for complete search history.

(56) References Cited

U.S. PATENT DOCUMENTS 4,805,674 A 2/1989 Knowlton
5,315,831 A 5/1994 Goode et al.
5,613,532 A 3/1997 Kaliszewski
(Continued)

OTHER PUBLICATIONS

T. V. Boyce, "How Alternative Fuel Filling Stations Work", retrieved from http://auto.howstuffworks.com/fuel-efficiency/hybrid-technology/alternative-fuel-filling-stations.htm on Nov. 3, 2015, 3 pages.

(Continued)

*Primary Examiner* — Timothy L Maust
*Assistant Examiner* — Andrew Schmid
(74) *Attorney, Agent, or Firm* — Lewis Roca Rothgerber Christie LLP

(57) ABSTRACT

A natural gas filling system may include a nozzle, a container including an internal manifold, wherein the manifold may be connected to a natural gas supply line, a first line may be operably connected to the manifold, wherein natural gas may be supplied to the nozzle, and a vent, wherein the vent is a second line may be operably connected to the nozzle that may release natural gas into the atmosphere.

16 Claims, 4 Drawing Sheets

(56) References Cited

U.S. PATENT DOCUMENTS

| | | | | |
|---|---|---|---|---|
| 2001/0029997 | A1* | 10/2001 | Walker | B67D 7/0486 141/95 |
| 2010/0101929 | A1* | 4/2010 | Kamen | B01D 1/28 202/185.3 |
| 2013/0112313 | A1 | 5/2013 | Donnelly et al. | |
| 2014/0261882 | A1* | 9/2014 | Lambrix | B67D 7/04 141/94 |
| 2014/0263420 | A1* | 9/2014 | Lambrix | F17C 7/00 222/3 |
| 2015/0013831 | A1 | 1/2015 | Boyer | |

OTHER PUBLICATIONS

"Compressed Natural Gas Fueling Stations", U.S. Department of Energy—Energy Efficiency and Renewable Energy, Alternative Fuels Data Center, retrieved from http://www.afdc.energy.gov/fuels/natural_gas_cng_stations.html on Nov. 3, 2015, 2 pages.

"Filling CNG Fuel Tanks", U.S. Department of Energy—Energy Efficiency and Renewable Energy, Alternative Fuels Data Center, retrieved from http://www.afdc.energy.gov/vehicles/natural_gas_filling_tanks.html on Nov. 3, 2015, 1 page.

"CNG Vehicle and Fueling System Solutions", Parker Hannifin Corporation brochure, copyright 2013, 12 pages.

* cited by examiner

NATURAL GAS TIME FILL POST SYSTEM

CROSS-REFERENCE TO RELATED APPLICATION

This application claims priority to and the benefit of U.S. Provisional Application No. 62/123,790, filed Nov. 26, 2015, the entire contents of which are incorporated herein by reference.

TECHNICAL FIELD

The present invention relates generally to natural gas fill post systems.

BACKGROUND OF THE INVENTION

Modern gas filling systems or the process of filling natural gas fueled vehicles are performed by one of two methods, the fast fill or the time fill.

The fast fill process is similar to conventional gasoline or Diesel filling processes in that the vehicle pulls up to a compressed natural gas (CNG) dispenser, the filling nozzle is connected to the fill port and the vehicle CNG tank is filled rapidly as possible from the CNG system storage tanks, the CNG compressor or a combination of both. The filling process is as rapid as the CNG tank and compressor system can deliver. To achieve a full tank of CNG, the tank is typically overfilled to compensate for the heat of compression that occurs during the rapid or fast filling process.

The time fill process consists of connecting one or more vehicles to a common CNG system. The check valve in the vehicle CNG tank prevents gas outflow from the tank and only allows flow to the tank. However, as multiple vehicles are connected, the lowest pressure tank fills first as the CNG compressor builds pressure.

The compressed natural gas slow or time fill post system is typically configured with a steel tube or support structure with the CNG conveyance tubing and valves attached to the support structure.

SUMMARY OF THE INVENTION

The present disclosure is directed to various embodiments of a natural gas filling system which may include a nozzle; a container including an internal manifold, wherein the manifold may be connected to a natural gas supply line; a first line may be connected to the manifold, wherein natural gas may be supplied to the nozzle; and a vent, wherein the vent may be a second line operably connected to the nozzle that releases natural gas into the atmosphere.

An isolation valve may be operably connected between the manifold and the natural gas supply line.

An upper section may be connected to the manifold, where the second line may be operably connected to the manifold, where the second line may be operably connected to the nozzle on the other end. Excess pressure may pass through the nozzle and continue through the second line, to the manifold then to the upper section, wherein natural gas may be released through the upper section. A vent cap may be operably coupled to the upper section.

A retraction unit may be coupled to the upper section wherein a cable may be extendable from the retraction unit and may attach to the first and second line. The cable may be retractable.

A breakaway section may be operably attached to the retraction unit.

A breakaway may be operably attached to the first and second line.

A foundation may be coupled to the manifold wherein the foundation may be coupled to the ground.

A nozzle dock may be coupled to the upper section where the nozzle is stored.

A base flange may be coupled to a foundation wherein the base flange may have a plurality of predetermined holes that may determine the orientation of the system based on how a fastening device is coupled to the predetermined holes. The system may be operably rotated based on how the plurality of predetermined holes on the base flange are positioned in relation to the foundation.

The natural gas supply line may be a high pressure tubing.

The container may be elongated along the longitudinal axis to provide support.

A method of supplying natural gas from a natural gas filling system may include a nozzle, a container including an internal manifold, wherein the manifold may be connected to a natural gas supply line. The method may include supplying, by a first line operably connected to the manifold, where natural gas may be supplied to the nozzle. The method may also include releasing, by a vent, wherein the vent may be a second line operably connected to the nozzle that may release natural gas into the atmosphere.

The method of the system may further include an isolation valve operably connected between the manifold and the natural gas supply line.

The method of the system may further include an upper section, wherein the upper section may be connected to the manifold, wherein the second line may be operably connected to the manifold, wherein the second line may be operably connected to the nozzle on the other end, wherein excess pressure may pass through the nozzle and continue through the second line, to the manifold then to the upper section, wherein natural gas may be released through the upper section. A vent cap may be operably coupled to the upper section.

The system may further include a retraction unit coupled to the upper section wherein a cable may extend from the retraction unit and attach to the first and second line, wherein the cable may be retractable.

The system may further include a breakaway section operably attached to the retraction unit.

The system may further include a breakaway operably attached to the first and second line.

The system may further include a foundation wherein the manifold may be coupled to the foundation wherein the foundation may be coupled to the ground.

The system may further include a nozzle dock coupled to the upper section wherein the nozzle may be stored.

The system may further include a base flange coupled to a foundation wherein the base flange may have a plurality of predetermined holes that determines the orientation of the system based on how a fastening device may be coupled to the predetermined holes, wherein the system may be operably rotated based on how the plurality of predetermined holes on the base flange are positioned in relation to the foundation.

The natural gas supply line may be a high pressure tubing.

The container may be elongated along the longitudinal axis to provide support.

This summary is provided to introduce a selection of concepts that are further described below in the detailed description. This summary is neither intended to identify key or essential features of the claimed subject matter, nor is it intended to be used in limiting the scope of the claimed subject matter.

BRIEF DESCRIPTION OF THE DRAWINGS

The features and advantages of embodiments of the present disclosure will become more apparent by reference to the following detailed description when considered in conjunction with the following drawings. In the drawings, like reference numerals are used throughout the figures to reference like features and components. The figures are not necessarily drawn to scale.

DETAILED DESCRIPTION

Figure 1:
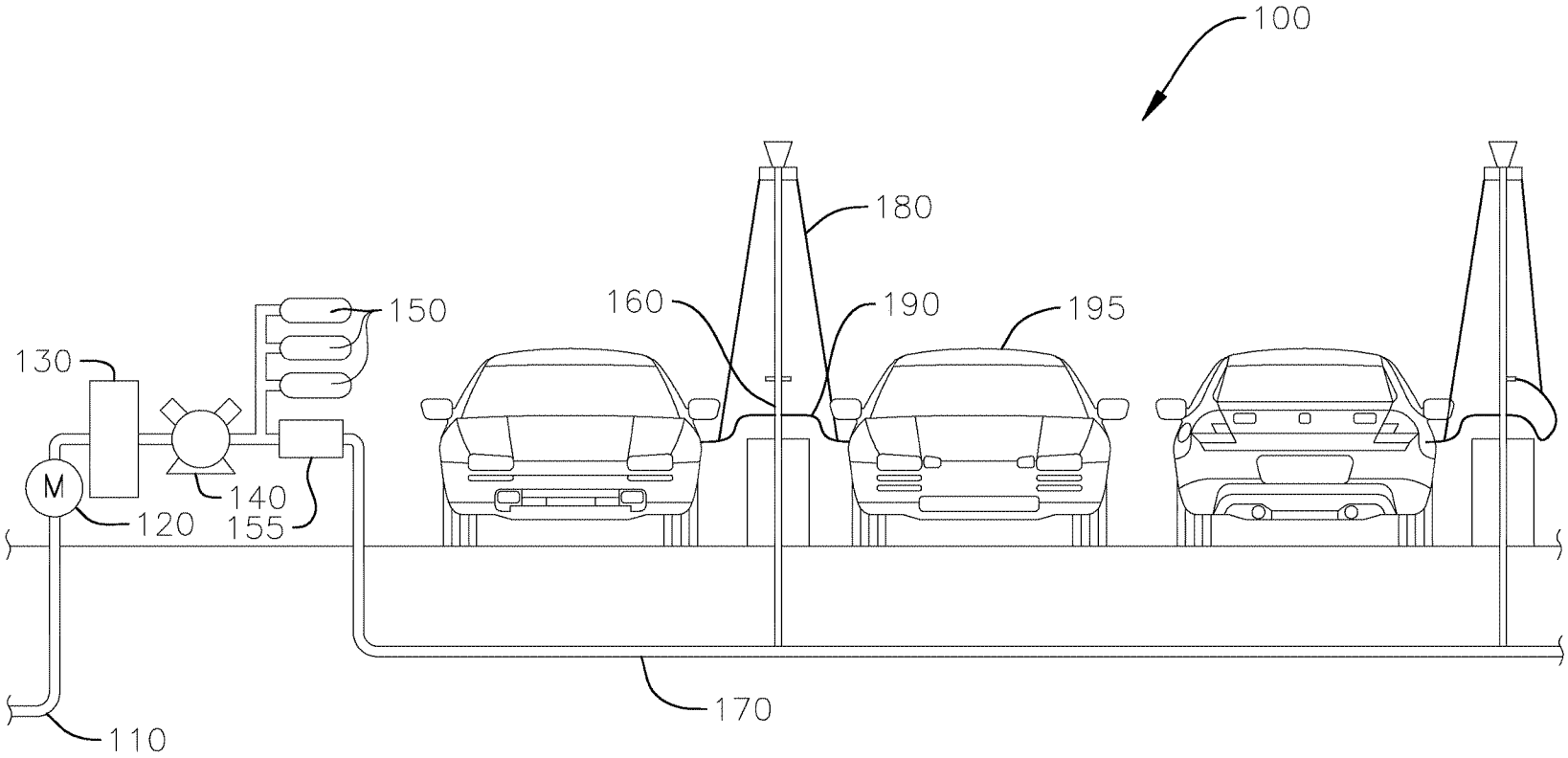
FIG. 1 is a schematic diagram illustrating an embodiment of the present invention.

Features of the inventive concept and methods of accomplishing the same may be understood more readily by reference to the following detailed description of embodiments and the accompanying drawings. The inventive concept may, however, be embodied in many different forms and should not be construed as being limited to the embodiments set forth herein. Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

It should be noted that for the purposes of this application the term "Compressed Natural Gas" or any other alternative fuel sources are interchangeable and are not limited to such terms listed herein. Furthermore, any alternative fueling sources with similar delivery properties may benefit from embodiments of the present invention.

Embodiments of the present invention provide simplified installation and a reduction in the number of CNG fittings. The reduction in the number of CNG fittings has several benefits and advantages over what is currently available. First, reducing the number of fittings lowers the cost of the assembly. Second, reducing the number of fittings reduces the number of potential leak points (the maximum working or test pressure of CNG systems is typically 5,500 psi). Further, reducing the number of fittings also increases the safety of the assembly since there are fewer failure points.

Embodiments of the present invention integrate the support structure into the CNG conveyance system, both the CNG pressure supply and return vent lines.

An advantage of one or more embodiments of the present invention is that the CNG manifold also acts as a support structure. Although tubing is still required to deliver CNG to the time fill post system, no additional tubing or tee fittings are required between the inlet to the manifold and the vehicle hose connection.

Now referring to FIG. 1, a schematic diagram illustrating an embodiment of the present invention is shown. The time fill station 100 has a gas supply line 110 that delivers fuel at a low pressure to a compressor on site 140. It may go through a gas meter 120 and gas dryer 130. Although there may be one or more small buffer storage tanks or bottles 150, their purpose is not to fill vehicles, but to keep the compressor 140 from turning off and on unnecessarily, wasting electricity, and causing undue wear and tear on the compressor 140. The natural gas control system 155 supplies the time fill natural gas supply line 170 which is distributed to the time fill post assembly 160 from which vehicles 195 are filled by using a supply hose 190. In addition, there may be a retraction unit 180 coupled to the station.

An advantage of one or more embodiments of the present invention is that the CNG manifold 210, as will be seen in FIG. 2 and discussed more fully below, also acts as a support structure. Although tubing is still required to deliver CNG to the time fill post system, no additional tubing or tee fittings are required between the inlet to the manifold and the vehicle hose connection.

Furthermore, as will be seen in FIG. 3 and discussed more fully below, the manifold may be configured from one to four or more fueling positions from the same part by pugging off the unused filling positions. However, as can be seen in FIG. 1, the station 100 has two fueling positions, with capability of adding more positions from a single manifold.

In addition, a vent 217, as will be seen in FIG. 2 and discussed more fully below, is coupled to the manifold.

Figure 2:
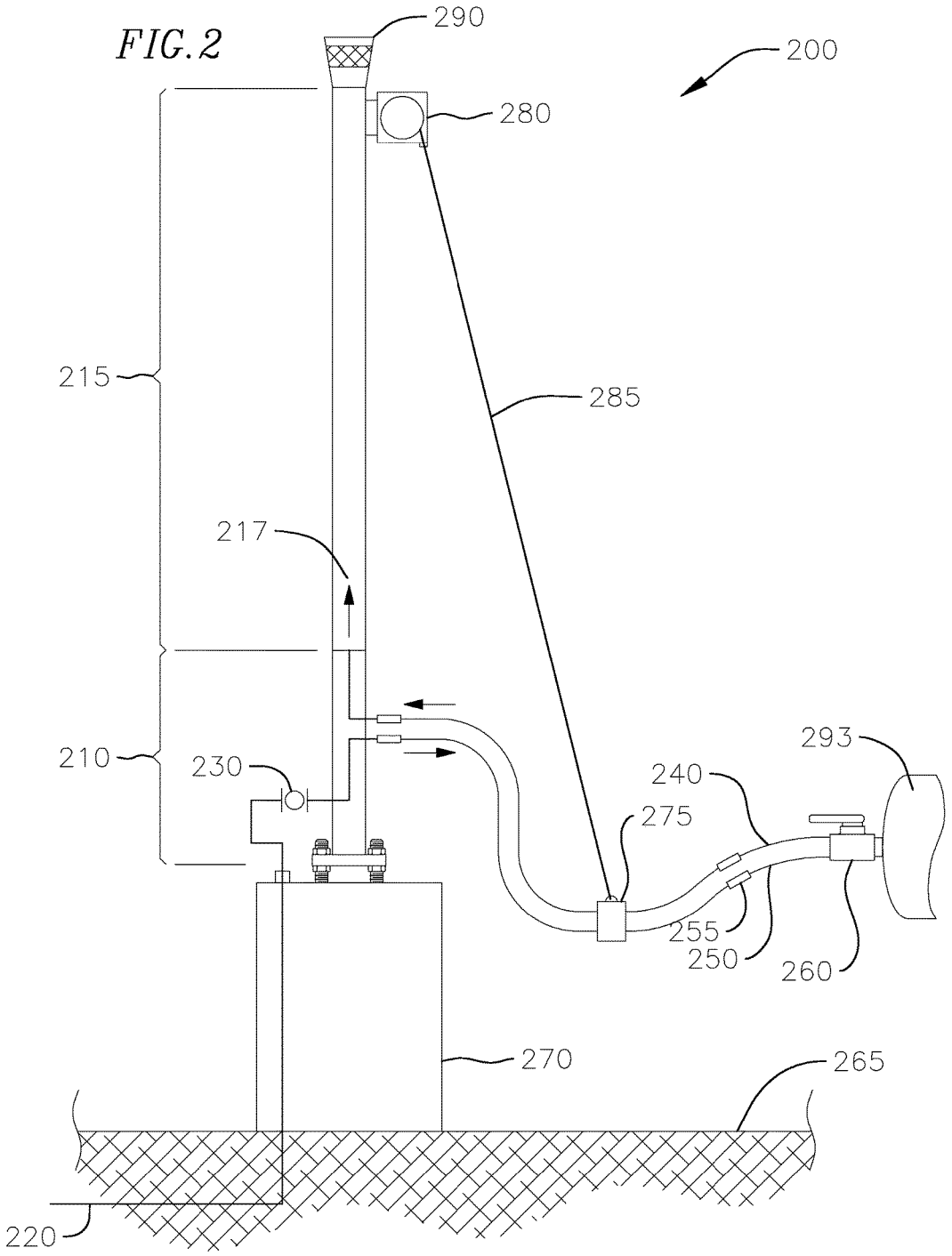
FIG. 2 is a perspective view of an embodiment of a gas filling system.

Now referring to FIG. 2, a natural gas filling system 200 according to one embodiment of the present disclosure includes a nozzle 260, a container including an internal manifold 210, wherein the manifold 210 is connected to a natural gas supply line 220; a first line 250 operably connected to the manifold 210, wherein natural gas is supplied to the nozzle 260; and a vent 217, wherein the vent 217 is a second line 240 operably connected to the nozzle 260 that releases natural gas into the atmosphere.

The nozzle 260 may be any configuration typical for gas fill systems to those persons having ordinary skill in the particular subject matter. The internal manifold 210 may be also referred to as a manifold for the purposes of this application. The manifold 210 may have an inner channel system where the natural gas flows. The first line 250 may be connected to the manifold 210. Once the natural gas enters the manifold, the gas may be distributed to the first line where it may subsequently proceed to the nozzle. As a non-limiting example, the nozzle may connect to the compressed gas tank to commence the filling of the gas tank or vehicle. A second line 240 may also be connected to the nozzle. The second line may act as a conduit for gas to be carried to the vent 217 through the manifold. The second line may also release the high pressure gas trapped in the nozzle fill port between the nozzle valve and the vehicle tank check valve. Consequently, this gas pressure may be relieved to the atmosphere before the nozzle may be removed from the vehicle. There may be a pressure relieve valve (PRV) situated on the compressor and CNG distribution system to prevent excessive pressure from going to the time fill system and onto the vehicle tank. Vehicle tanks are protected with a separate PRV which vents through the vehicle and not the fill port.

The natural gas supply line 220 may deliver natural gas to the filling station 200 through an isolation valve 230. The isolation valve may be connected to the supply line in order to stop the flow of the gas. The isolation valve may be used for diverting gas, facilitating maintenance, equipment removal, and shutdown in the case of an emergency. Once the gas passes through the isolation valve, the gas may continue to the first line where it may continue to the nozzle and then to the intended destination.

The natural filling system 200 may also include an upper section 215. As a non-limiting example, the upper section may be an elongated structure which connects to the manifold 210. The second line 240 may be connected to the manifold 210 in which the second line may be connected to the nozzle 260. The second line releases the high pressure gas trapped in the nozzle fill port between the nozzle valve and the vehicle tank check valve. Consequently, this gas pressure may be relieved to the atmosphere before the nozzle may be removed from the vehicle. There may be a pressure relieve valve (PRV) situated on the compressor system to prevent increased pressure from going to the time fill system and onto the vehicle tank which vents through the vehicle and not the fill port.

The gas may continue through the length of the upper section where the gas may be expelled through the far end of the upper section and then the natural gas may be released into the atmosphere. The upper section may have a vent cap 290, which is attached to the upper section in order to prevent rain, insects or debris from entering the upper section.

The upper section may also include a retraction unit 280. The retraction unit may be coupled to the upper section where a cable may extend from the retraction unit. The cable may then attach to the first and second line. As such, if the user pulls the nozzle from its resting position toward the intended target, then the cable from the retraction unit would release the cable. When the user is done filling their tank, they would release the nozzle, which in effect would release the first and second lines. The retraction unit would then retract the cable towards the unit back into the resting position. As a non-limiting example, the retraction unit may be spring-loaded, which would retract the cable once released. The retraction unit may be any form of retraction unit that is readily available in the market, for example, OPW Retail Fueling POMECO 102 Spring Balance Hose Retractor or the FASTECH TFP Hose Retractor.

The retraction unit 280 may include a breakaway section 275. The breakaway section may be attached to the retraction unit. As a non-limiting example, the breakaway section may be located at the end of the cable 285 and the point which attaches to the first and second lines 240, 250. As another non-limiting example, the breakaway section may be activated if a careless driver decides to drive away accidentally with the nozzle still attached to the tank, at which point the breakaway section would detach from the system 200 and allow the driver to drive with the nozzle still attached to the tank, and thereby preventing more damage to the system.

In addition to the breakaway section 275 of the retraction unit 280, the system may have a separate or another breakaway 255 that is attached to the first and second lines 240, 250. The breakaway 255 would prevent excessive force on the system in the event of vehicle drive off or when the vehicle leaves the system with the nozzle still attached to the vehicle. The breakaway attached to the first and second lines may be any form of breakaway device that is readily available in the market, for example, OPW ILB-1, Parker Snap-Tite NGVBCN2-P50, Staubli BRW 02, or WEH TSA6.

Figure 3:
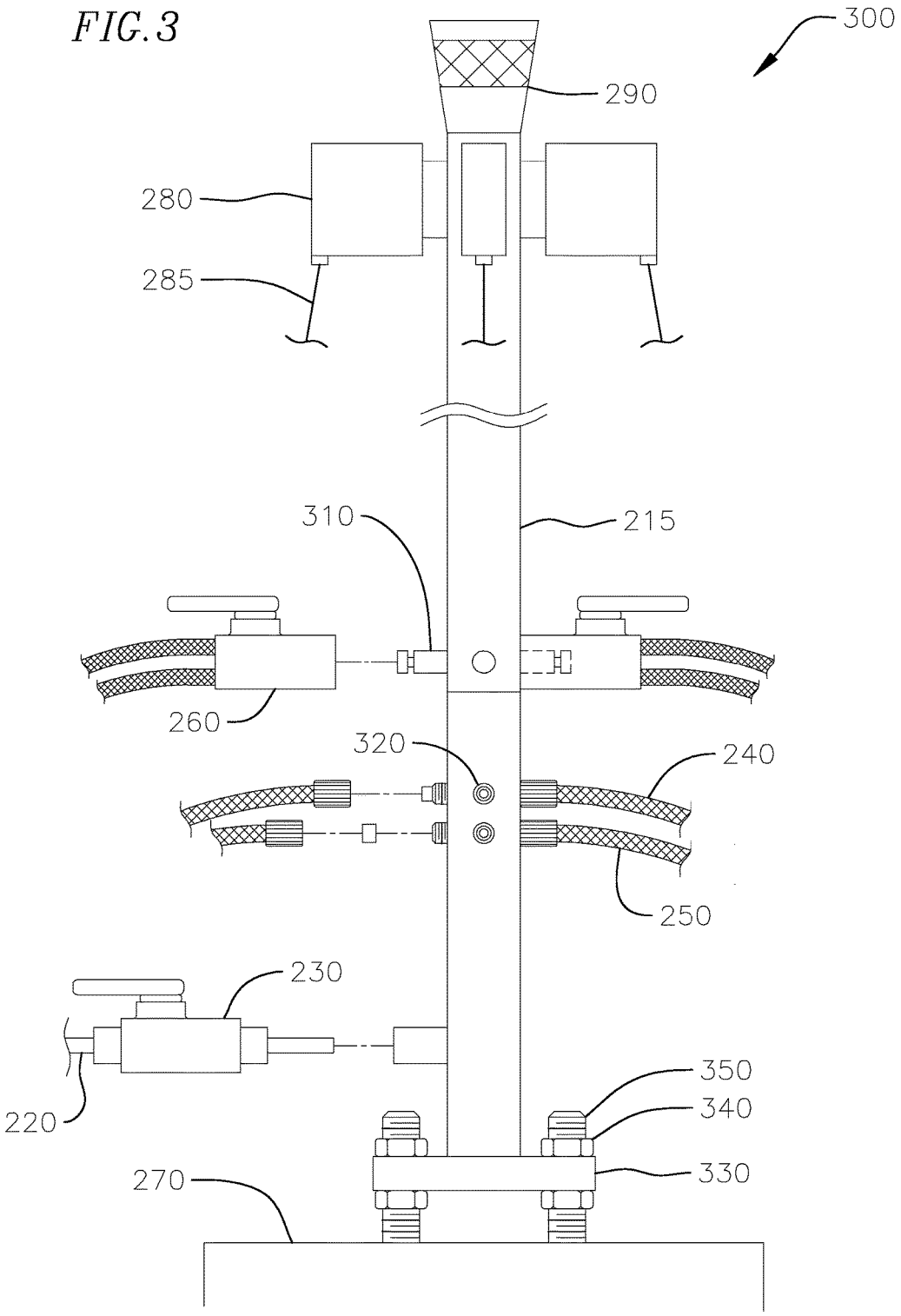
FIG. 3 is a perspective view of the embodiment of the gas filling system illustrated in FIG. 2.

Now referring to FIG. 3, a natural gas filling system 200 according to one embodiment is seen in more detail. The manifold 210 may be coupled to a foundation which may be coupled to the ground 265. As a non-limiting example, the manifold may be coupled to the foundation by bolt or welding. Moreover, the foundation may be bolted or welded to the ground as well. As a non-limiting example, the system may also be mounted to either a concrete caisson or precast K-rail (also known as a Jersey Barrier) 270.

The nozzle 260 may be placed on a nozzle dock 310 when not in use. The nozzle dock may be coupled to the upper section 215. This may make it easier for the user to access the nozzle. As a non-limiting example, one or more nozzle docks may be placed around the system as to accommodate the particular number or set of nozzles. As a non-limiting example, the system may have one, two, three, or four outlets in order for a multiple number of users to use the system at the same time. As such, when one port is not used, then a plug 320 may be inserted into that port in order to protect it from the elements and misuse.

Figure 4:
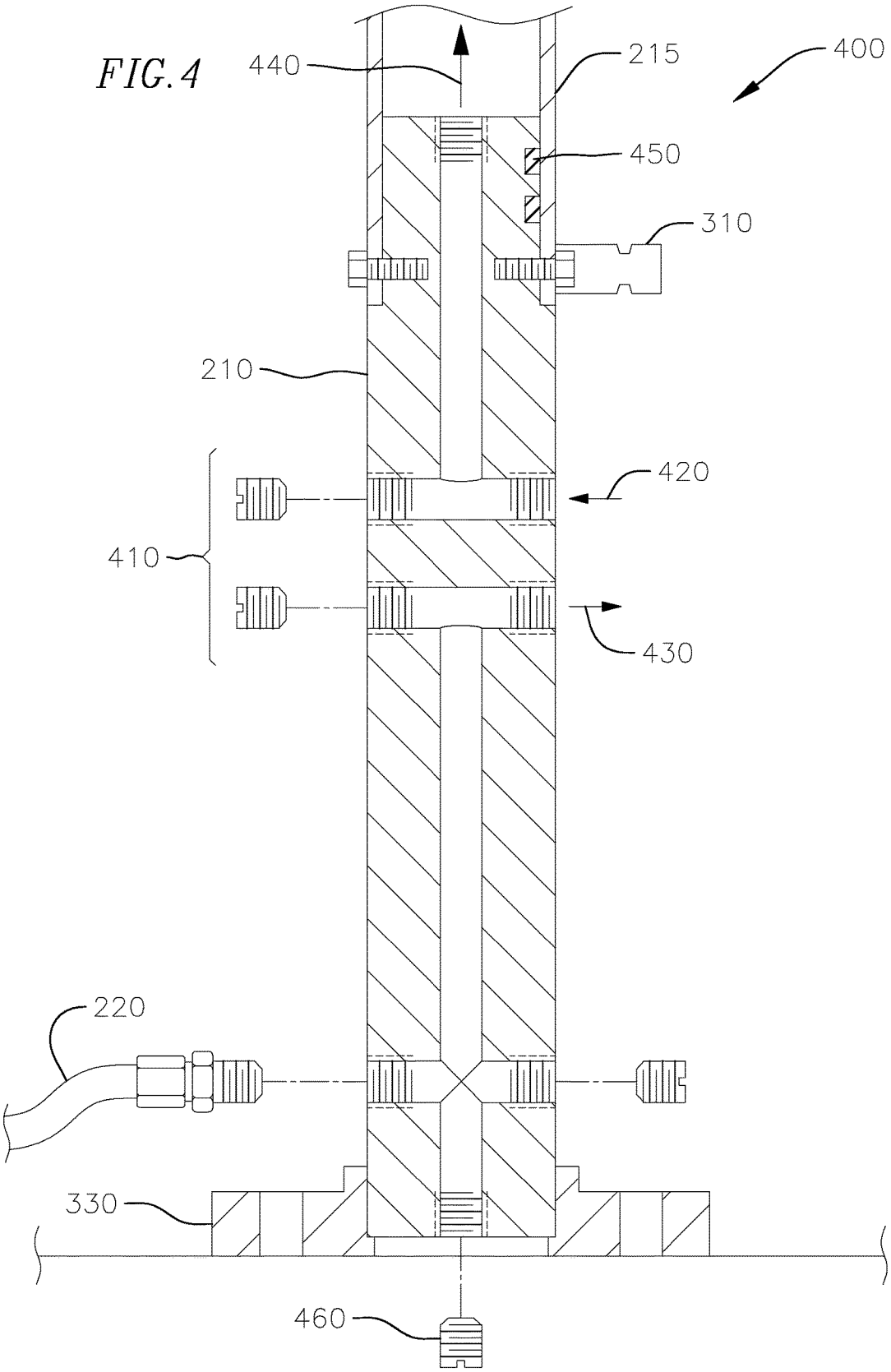
FIG. 4 is a cross-sectional view of the embodiment of the gas filling system illustrated in FIG. 2.

Now referring to FIG. 4, a natural gas filling system 200 according to one embodiment is seen in cross section view. A base flange 330 may be coupled to a foundation where the base flange has a plurality of predetermined holes 340 that determines the orientation of the system based on how a fastening device 350 is coupled to the predetermined holes. The system may be oriented based on how the plurality of predetermined holes on the base flange are positioned in relation to the foundation. As a non-limiting example, the bottom of the system may be configured with a flange 330 with eight mounting holes, however, only four are used in which the system is able to be rotated 45 degrees based on how the predetermined holes are fastened. As another non-limiting example, the fastening device may be bolts and nuts. This provides an advantage by allowing the manifold to be rotated in any increment of 45 degrees to allow for varying parking stall alignment orientations.

As a non-limiting example, the system may be mounted to either a concrete caisson or precast K-rail (also known as a Jersey Barrier) 270. For caisson installations, the supply line 220 from the compressor is typically stubbed up within the caisson with a branch connection to the system with another stub for the supply line to the adjacent system. An optional system inlet connection kit may be used which includes a branch tee and elbow for ¾ inch and 1 inch CNG tubing, reducer fittings to ⅜ inch tubing, ⅜ inch ball valve or isolation valve 230, compression fittings and pre-bent tubing sections. As another non-limiting example, a connection kit for the last system in the line may only require a single connection point. For caisson mounting, an anchor bolt kit may be available which may include anchor rods, nuts and mounting template.

K-rail may be installed by using a bent steel plate mounting kit which may consist of a bracket for mounting to a typical 6 inches width precast angle face impact barrier and necessary anchor bolts (bracket to K-rail) and ⅝ inch bolts and nuts for attaching the system. The mounting bracket may be a two piece assembly with each half anchored to the face of the K-rail. One bracket may be configured with holes; the other with slots to allow for variations in the width of the K-rail. The system may be mounted above the K-rail to allow for the supply line tubing to clean under the assembly if required.

The natural gas supply line 220 may be high pressure tubing. High pressure tubing would allow for the supply line to safely transport the gas from one location to another.

The container may be elongated along the longitudinal axis to provide support. As a non-limiting example, the elongated container may provide support for the retracting unit, the vent, vent cap or any other features.

As a non-limiting example, the upper section 215 may be attached to the manifold 210 with bolts and may be sealed with gaskets or O-rings 450.

The manifold may have a port 420 to connect to the second line 240 and a port 430 to the first line 250. Plugs 410 may be inserted in the unused ports. A bottom plug 460 may be inserted into the bottom of the manifold. The bottom plug may allow for connection at bottom which is used for some installations and would also allow for machining of the manifold.

The system 200 may provide a method of supplying natural gas from a natural gas filling system including a nozzle 260, a container comprising an internal manifold 210, where the manifold is connected to a natural gas supply line 220. The method may include the steps of supplying, by a first line 250 connected to the manifold, where natural gas is supplied to the nozzle; and releasing, by a vent, where the vent is a second line 240 connected to the nozzle that releases natural gas into the atmosphere.

The design of the system 200 allows for a single manufactured item to be used for from one to four filling positions without modification or additional tube fittings. An advantage of the manifold system is that the unit can be easily broken down for shipping. Another advantage of the system is that any of the four filling positions 420, 430 may be activated by simply removing the sealing plugs 410. Since the manifold can be configured from one to four filling positions from the same part by simply plugging off the unused fueling positions this offers several advantages. As such, this configuration option simplifies manufacturing, inventorying and distribution.

In addition, a method of supplying natural gas from a natural gas filling system is described. The method may include the features described previously in the present application.

What is claimed is:

1. A natural gas filling system, comprising:

a nozzle;

a container comprising an internal manifold, wherein the manifold is connected to a natural gas supply line;

a first line operably connected to the manifold, wherein natural gas is supplied to the nozzle;

a vent, wherein the vent is a second line operably connected to the nozzle that releases natural gas into the atmosphere;

an upper section, wherein the upper section is connected to the manifold, wherein the second line is operably connected to the manifold, wherein the second line is operably connected to the nozzle on the other end, wherein excess pressure passes through the nozzle and continues through the second line, to the manifold then to the upper section, wherein natural gas is released through the upper section; and a vent cap operably coupled to the upper section.

2. The system of claim 1, further comprising an isolation valve operably connected between the manifold and the natural gas supply line.

3. The system of claim 1, further comprising a retraction unit coupled to the upper section wherein a cable is extendable from the retraction unit and attaches to the first and second line, wherein the cable is retractable.

4. The system of claim 1, further comprising a breakaway operably attached to the first and second line.

5. The system of claim 1, further comprising a foundation wherein the manifold is coupled to the foundation wherein the foundation is coupled to the ground.

6. The system of claim 1, further comprising a nozzle dock coupled to the upper section wherein the nozzle is stored.

7. The system of claim 1, further comprising a base flange coupled to a foundation wherein the base flange has a plurality of predetermined holes that determines the orientation of the system based on how a fastening device is coupled to the predetermined holes, wherein the system may be rotated operably based on how the plurality predetermined holes on the base flange are positioned in relation to the foundation.

8. The system of claim 1, wherein the container is elongated along the longitudinal axis to provide support.

9. A method of supplying natural gas from a natural gas filling system including a nozzle, a container comprising an internal manifold, wherein the manifold is connected to a natural gas supply line, comprising the step of:

supplying, by a first line operably connected to the manifold, wherein natural gas is supplied to the nozzle; and releasing, by a vent, wherein the vent is a second line operably connected to the nozzle that releases natural gas into the atmosphere, wherein the system further comprises:

an upper section, wherein the upper section is connected to the manifold, wherein the second line is operably connected to the manifold, wherein the second line is operably connected to the nozzle on the other end, wherein excess pressure passes through the nozzle and continues through the second line, to the manifold then to the upper section, wherein natural gas is released through the upper section; and a vent cap operably coupled to the upper section.

10. The method of claim 9, wherein the system further comprises an isolation valve operably connected between the manifold and the natural gas supply line.

11. The method of claim 9, wherein the system further comprises a retraction unit coupled to the upper section wherein a cable is extendable from the retraction unit and attaches to the first and second line, wherein the cable is retractable.

12. The method of claim 9, wherein the system further comprises a breakaway operably attached to the first and second line.

13. The method of claim 9, wherein the system further comprises a foundation wherein the manifold is coupled to the foundation wherein the foundation is coupled to the ground.

14. The method of claim 9, wherein the system further comprises a nozzle dock coupled to the upper section wherein the nozzle is stored.

15. The method of claim 9, wherein the system further comprises a base flange coupled to a foundation wherein the base flange has a plurality of predetermined holes that determines the orientation of the system based on how a fastening device is coupled to the predetermined holes, wherein the system may be rotated operably based on how the plurality predetermined holes on the base flange are positioned in relation to the foundation.

16. The method of claim 9, wherein the container is elongated along the longitudinal axis to provide support.

* * * * *